US011643762B2

(12) United States Patent
Hsiao

(10) Patent No.: US 11,643,762 B2
(45) Date of Patent: May 9, 2023

(54) KNITTED FABRIC WITH LEATHER FIBERS AND MANUFACTURING METHOD THEREOF

(71) Applicant: ZHONGSHAN YOURWAY FASHION TECHNOLOGY LTD., Zhongshan (CN)

(72) Inventor: Chin-Hsun Hsiao, Zhongshan (CN)

(73) Assignee: ZHONGSHAN YOURWAY FASHION TECHNOLOGY LTD., Zhongshan (CN)

( * ) Notice: Subject to any disclaimer, the term of this patent is extended or adjusted under 35 U.S.C. 154(b) by 205 days.

(21) Appl. No.: 16/951,583

(22) Filed: Nov. 18, 2020

(65) Prior Publication Data

US 2021/0164136 A1 Jun. 3, 2021

(30) Foreign Application Priority Data

Nov. 29, 2019 (TW) ..... 108143672

(51) Int. Cl.
*D04B 21/04* (2006.01)
*D04B 1/04* (2006.01)

(52) U.S. Cl.
CPC ..... *D04B 21/04* (2013.01); *D04B 1/04* (2013.01); *D10B 2331/10* (2013.01)

(58) Field of Classification Search
CPC ... D04B 1/14; D04B 1/16; D04B 1/22; D04B 21/14; D04B 21/16; D10B 2403/02
See application file for complete search history.

(56) References Cited

U.S. PATENT DOCUMENTS 3,436,303 A * 4/1969 Fraser ..... D21H 5/12 162/146
4,011,130 A * 3/1977 Worden ..... D06N 3/14 162/207
5,958,554 A * 9/1999 Addie ..... C08L 89/06 428/196
2010/0075559 A1* 3/2010 Hatori ..... B32B 5/026 442/308

FOREIGN PATENT DOCUMENTS

DE 202004019139 U1 * 4/2005 ..... D02G 3/36
DE 102005059010 A1 * 6/2006 ..... D02G 3/36
JP 2012097364 A * 5/2012

* cited by examiner

*Primary Examiner* — Danny Worrell
*Assistant Examiner* — Aiying Zhao
(74) *Attorney, Agent, or Firm* — Muncy, Geissler, Olds & Lowe, P.C.

(57) ABSTRACT

The present invention provides a knitted fabric with leather fibers comprising a ground yarn layer and a face yarn layer directly connected with the ground yarn layer through double knitting. The ground yarn layer includes a plurality of first yarn loops, each of the first yarn loops is formed by a plurality of ground yarns. The face yarn layer includes a plurality of second yarn loops, each of the second yarn loops is formed by at least one face yarn attached with the leather fibers obtained from a piece of leather by a pulverization operation. A course ratio of the face yarn layer to the ground yarn layer is in a range between 1:1.25 and 1:4. Accordingly, the invention provides an innovative knitted fabric and solves the problem that the leather cannot be recycled after being discarded.

6 Claims, 12 Drawing Sheets

KNITTED FABRIC WITH LEATHER FIBERS AND MANUFACTURING METHOD THEREOF

FIELD OF THE INVENTION

The invention relates to a knitted fabric and a manufacturing method thereof, and more particularly to a knitted fabric with leather fibers and a manufacturing method thereof.

BACKGROUND OF THE INVENTION

Leather becomes a commonly used craft material nowadays, but leather cannot be decomposed after it is processed and made. As a result, waste leather can only be incinerated and cannot be recycled.

With the rising awareness of environmental protection, many companies have tried to recycle waste. Leather reused also has been one of the problems thereof. In one of the existing manufacturing methods, it cuts the waste leather into scraps to form a plurality of leather fibers, and then attaches the plurality of leather fibers to a base yarn to make a leather yarn. However, due to different sizes of the leather fibers, strength of the leather yarn is inferior to that of cotton. Also, a surface of the fabric knitted from the leather yarn is uneven and the strength is obviously insufficient, resulting in the fabric knitted from the leather yarn having an uncomfortable tactile feeling and easily to be damaged.

SUMMARY OF THE INVENTION

A main object of the invention is to solve the problems of uncomfortable tactile feeling and poor strength of conventional fabrics knitted from leather yarns.

In order to achieve the above object, the invention provides a knitted fabric with leather fibers. The knitted fabric comprises a ground yarn layer and a face yarn layer directly connected to the ground yarn layer through double knitting. The bottom yarn layer includes a plurality of first yarn loops, each of the plurality of first yarn loops formed with a plurality of ground yarns. The face yarn layer is directly connected to the ground yarn layer through double knitting, and the face yarn layer includes a plurality of second yarn loops, each of the plurality of second yarn loops formed with at least one face yarn attached with the leather fibers, wherein the leather fibers are obtained from a piece of leather by a pulverization operation, and a course ratio of the face yarn layer to the ground yarn layer is ranged between 1:1.25 and 1:4.

In one embodiment, the face yarn includes a base yarn and a polyurethane (PU) layer which is wrapped around a surface of the base yarn and comprises the leather fibers.

In one embodiment, the base yarn is made of thermoplastic polyurethane (TPU).

In one embodiment, the knitted fabric includes a reinforcing layer provided on a side of the face yarn layer that is not connected to the ground yarn layer.

In one embodiment, a plurality of leather textures is formed on the reinforcing layer.

In addition to the foregoing, the invention further provides a manufacturing method for a knitted fabric with leather fibers, comprising steps of:

step A: double knitting a plurality of ground yarns and at least one face yarn by a flat knitting machine to form the knitted fabric, wherein the face yarn is attached with the leather fibers obtained from a piece of leather by a pulverization operation, and the knitted fabric comprises a ground yarn layer and a face yarn layer, and wherein the ground yarn layer comprises a plurality of first yarn loops respectively formed with the plurality of ground yarns, the face yarn layer comprises a plurality of second yarn loops respectively formed with the face yarn, a course ratio of the face yarn layer to the ground yarn layer is ranged between 1:1.25 and 1:4, and a yarn tension of the face yarn is less than a yarn tension of the ground yarn during knitting by the flat knitting machine; and step B: ironing the knitted fabric.

In one embodiment, the manufacturing method includes step C: hot pressing the face yarn layer.

In one embodiment, the manufacturing method includes step D: disposing a thermoplastic film on the face yarn layer, and hot pressing the thermoplastic film to form a reinforcing layer.

In one embodiment, in step D, hot pressing the thermoplastic film by using a leather texture mold to form a plurality of leather textures on the reinforcing layer.

In one embodiment, the thermoplastic film is made of polyurethane (PU) material.

In one embodiment, the face yarn is manufactured by wrapping a leather slurry around a base yarn and treated with baking, the leather slurry is made by mixing a liquid polyurethane with the leather fibers, and the base yarn is made of a thermoplastic polyurethane (TPU).

Accordingly, compared with the conventional technique, the invention has the following features: the invention provides the innovative knitted fabric, and solves the problem that the leather cannot be reused after being discarded.

DETAILED DESCRIPTION OF THE PREFERRED EMBODIMENTS

The detailed description and technical content of the invention are described below with reference to the drawings.

Figure 1:
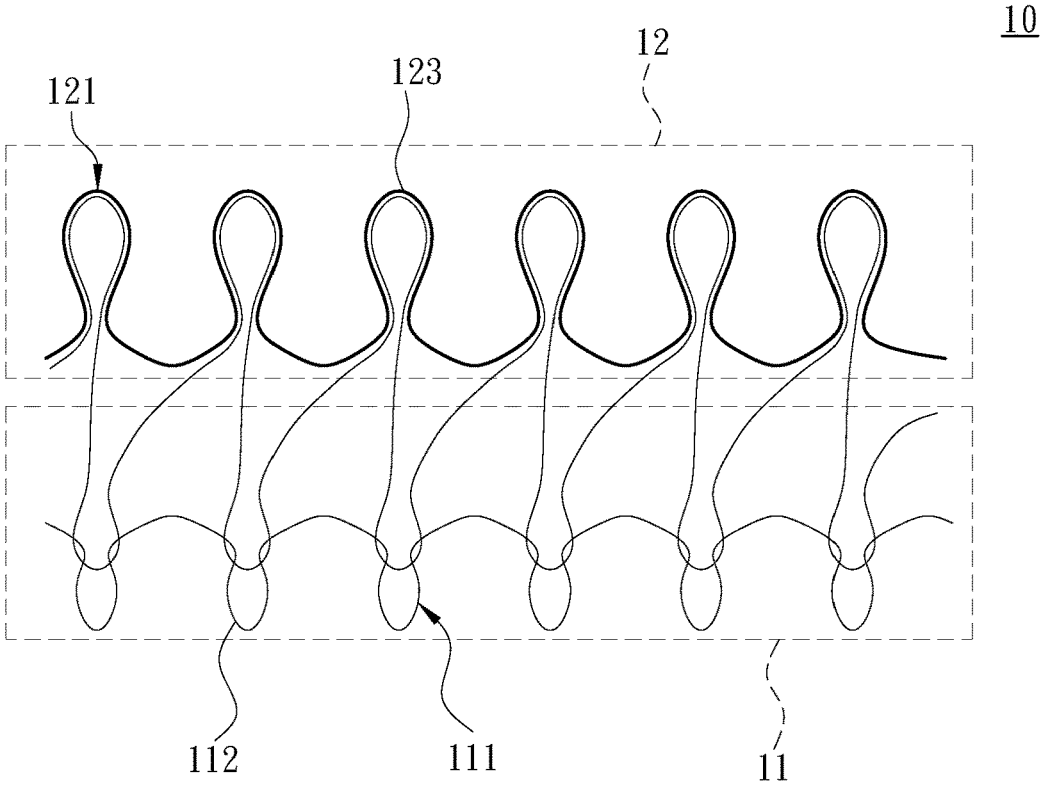
FIG. 1 is a schematic diagram of structure of a first embodiment of a knitted fabric of the invention.
Figure 2:
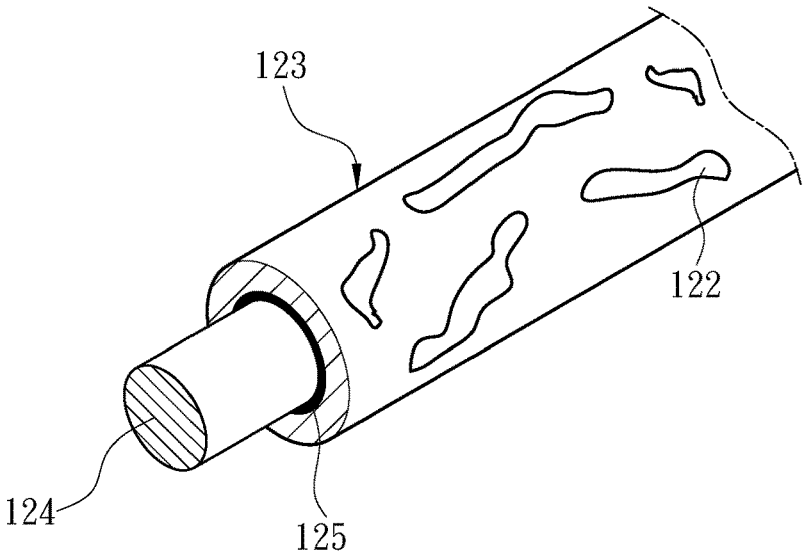
FIG. 2 is a schematic diagram of structure of a face yarn of the invention.

Please refer to FIG. 1 and FIG. 2. The invention provides a knitted fabric 10 with leather fibers. The knitted fabric 10 can be used to manufacture a garment, a shoe or a bag. The knitted fabric 10 is basically double knitted by a flat knitting machine (not shown in the figures). In addition, the knitted fabric 10 includes a ground yarn layer 11 and a face yarn layer 12. The ground yarn layer 11 includes a plurality of first yarn loops 111, and each of the first yarn loops 111 is formed with a plurality of ground yarns 112. The face yarn layer 12 is directly connected to the ground yarn layer 11 through double knitting. Double knitting is well-known for those skilled in the art and will not be described herein. In addition, the face yarn layer 12 includes a plurality of second yarn loops 121, and each of the second yarn loops 121 is formed with at least one face yarn 123 attached with a plurality of leather fibers 122. Further, the plurality of leather fibers 122 is obtained from a piece of leather by a pulverization operation, and the leather can be a new product or a recycled waste product. The pulverization operation refers to cutting the leather through machinery, and the leather is cut from an original sheet shape into scraps to form the plurality of leather fibers 122. In addition, sizes of the plurality of leather fibers 122 are not limited to be the same, and thicknesses of the plurality of leather fibers 122 are in a range between 0.5 mm and 2 mm. Furthermore, the face yarn 123 includes the plurality of leather fibers 122 as well as a base yarn 124 to carry the plurality of leather fibers 122. The base yarn 124 can be selected from different yarns according to implementation requirements which will not be described herein. In one embodiment, the base yarn 124 is made of thermoplastic polyurethane (TPU), which is obtained from recycling wastes with the thermoplastic polyurethane. In addition to the foregoing embodiment, the base yarn 124 can also be made of other environmentally friendly materials. Furthermore, a manufacturing process of the face yarn 123 provides as follows. After the plurality of leather fibers 122 is obtained, the plurality of leather fibers 122 is added to liquid polyurethane (PU) to make a leather slurry, and then the base yarn 124 is placed into the leather slurry with the plurality of leather fibers 122, so that the plurality of leather fibers 122 and the liquid polyurethane are wrapped around a surface of the base yarn 124. Subsequently, the base yarn 124 wrapped with the leather slurry is taken out and baking in an appropriate time to form the face yarn 123. At this time, the face yarn 123 is composed of the base yarn 124 and a polyurethane layer 125, which is wrapped around an outer surface of the base yarn 124 and comprises the plurality of leather fibers 122. The aforementioned baking step aims to remove moisture in the face yarn 123.

Considering that the face yarn 123 contains the plurality of leather fibers 122 with different sizes, a problem of poor strength and a risk of being easily damaged would occur, if fabrics knitted by the face yarn 123 thereof. In order to solve the above problems, the ground yarn layer 11 aims to strengthen the structure of the face yarn layer 12 except for being a backside of the knitted fabric 10. Therefore, a course ratio of the face yarn layer 12 to the ground yarn layer 11 is in a range between 1:1.25 and 1:4, and a yarn tension of the face yarn 123 is less than a yarn tension of the ground yarn 112 when the flat knitting machine is knitting. As shown in FIG. 1 for a schematic diagram of structure of the knitted fabric 10, numbers of courses of the ground yarn layer 11 is more than numbers of courses of the face yarn layer 12. That is to say, numbers of the first yarn loops 111 is more than numbers of the second yarn loops 121. Under the condition that lengths of the ground yarn layer 11 and the face yarn layer 12 are the same, a yarn loop density of the ground yarn layer 11 is greater than a yarn loop density of the face yarn layer 12. Here, a stronger knitting structure is formed to solve the problem of poor strength of the face yarn layer 12.

Figure 3:
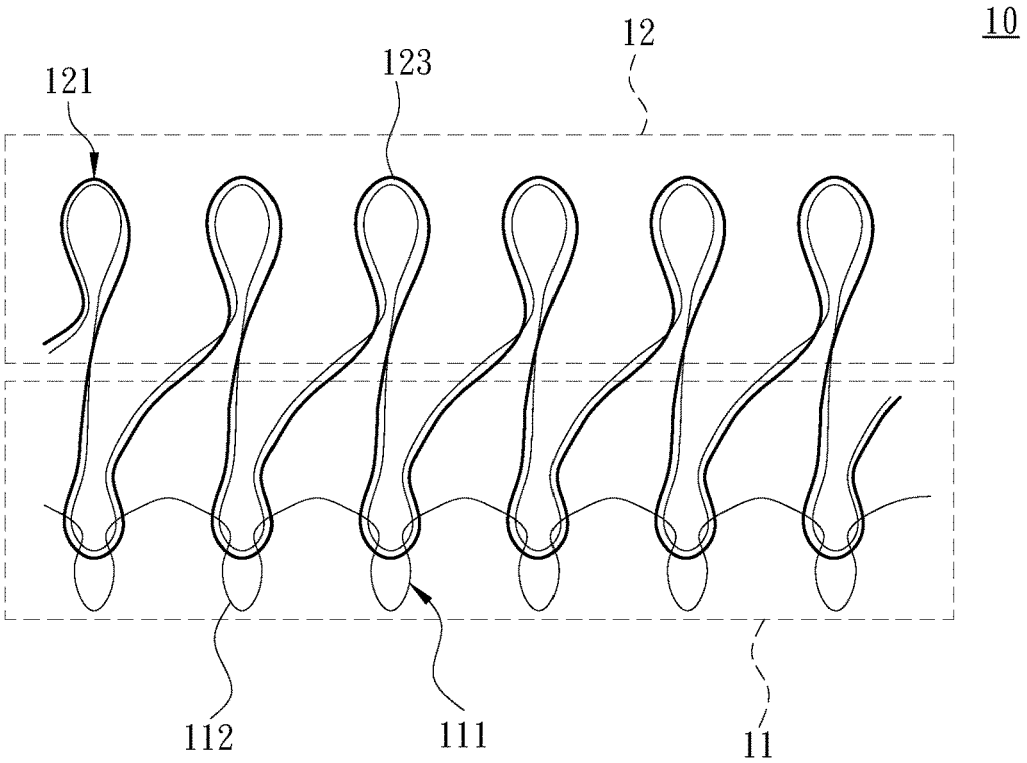
FIG. 3 is a schematic diagram of structure of a second embodiment of the knitted fabric of the invention.
Figure 4:
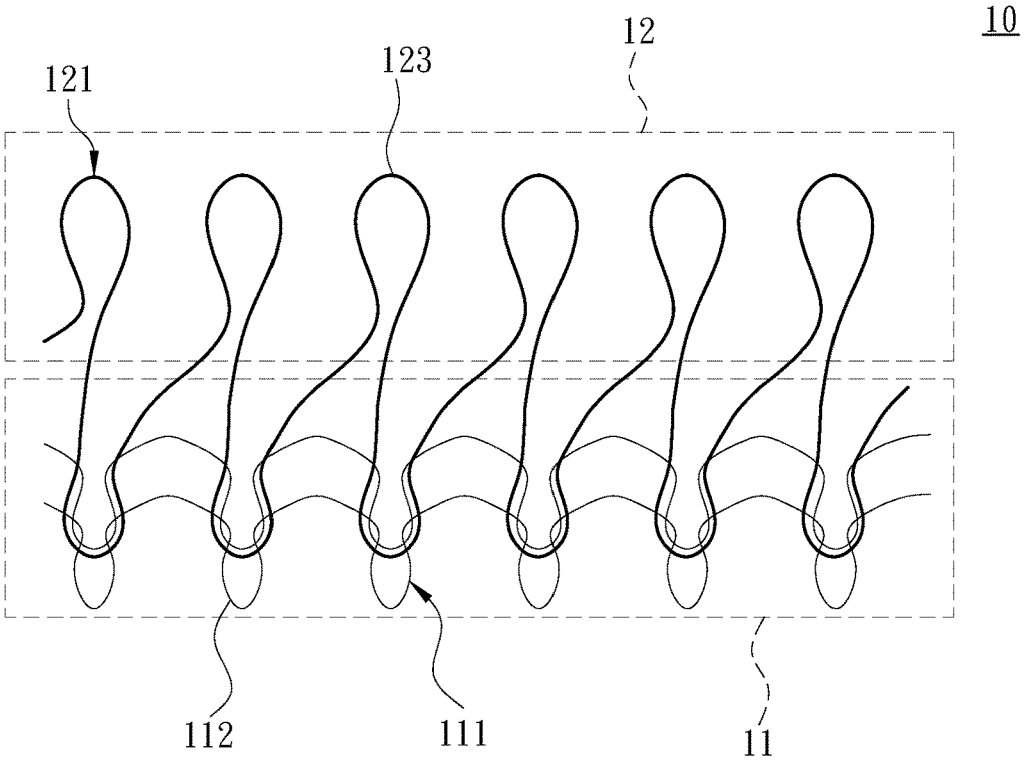
FIG. 4 is a schematic diagram of structure of a third embodiment of the knitted fabric of the invention.

Furthermore, in the invention, the connection between the ground yarn layer 11 and the face yarn layer 12 is not limited to a specific knitting structure to form the knitted fabric 10. As shown in FIG. 1, when two needle beds of the flat knitting machine are knitting, except for the face yarn 123, at least one of the ground yarns 112 is further fed to one of the two needle beds for knitting the face yarn layer 12. Thus, the at least one of the ground yarns 112 not only forms the plurality of first yarn loops 111, but also cooperates with the face yarn 123 to form the plurality of second yarn loops 121, thereby the ground yarn layer 11 and the face yarn layer 12 are connected realized by the at least one of the ground yarns 112. In another embodiment as shown in FIG. 3, after one part of the plurality of first yarn loops 111 is knitted by the other one of the two needle beds for knitting the ground yarn layer 11, at least one of the ground yarns 112 and the face yarn 123 are together fed to the needle bed for knitting the ground yarn layer 11 to knit another part of the plurality of first yarn loops 111. Then, the at least one of the ground yarns 112 and the face yarn 123 are together fed to the needle bed for knitting the face yarn layer 12, whereby the connection between the ground yarn layer 11 and the face yarn layer 12 are realized by the face yarn 123 and the at least one of the ground yarns 112. Please refer to another embodiment in FIG. 4. The face yarn 123 is further fed to the needle bed for knitting the ground yarn layer 11 in one of knitting strokes, thus the ground yarn layer 11 and the face yarn layer 12 are connected realized by the face yarn 123.

Figure 5:
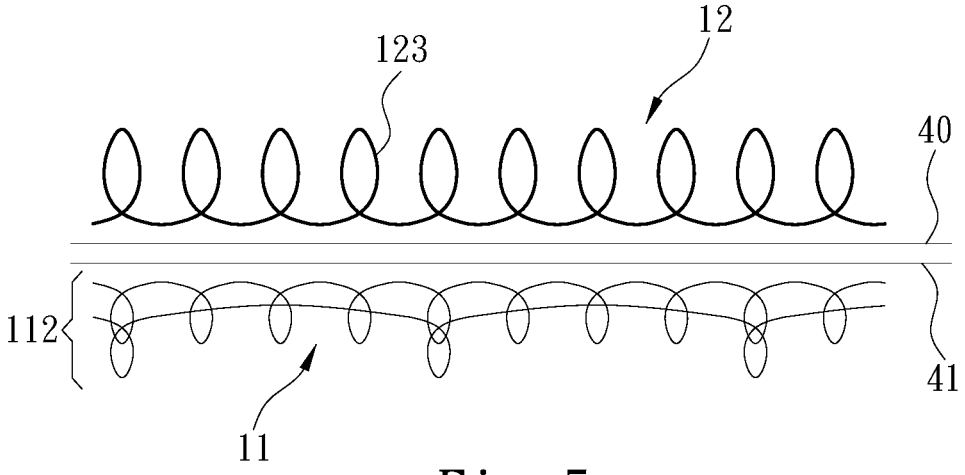
FIG. 5 is a simplified knitting diagram of the knitted fabric of the invention with a course ratio of 1:1.25.

Accordingly, please refer to FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, FIG. 20, FIG. 21, FIG. 22, FIG. 23, FIG. 24, and FIG. 25, which show simplified knitting of two needle beds 40, 41 of the flat knitting machine to meet the requirements that a course ratio of the face yarn layer 12 to the ground yarn layer 11 is in a range between 1:1.25 and 1:4. A structure of the two needle beds 40, 41 of the flat knitting machine is well-known in the technical field, so that knitting needles mentioned in the following description have no drawings and referenced numerals. FIG. 5 is a schematic diagram of one embodiment that a course ratio of the face yarn layer 12 to the ground yarn layer 11 is 1:1.25. Precisely, the course ratio is written as 1:1+(¼). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle of every four knitting needles thereof further stitches the ground yarn 112 again. Here, in practical knitting and feeding of the embodiment of FIG. 5, a yarn tension of the face yarn 123 is preferably set as approximately 1/1.25 times a yarn tension of the ground yarn 112.

Figure 6:
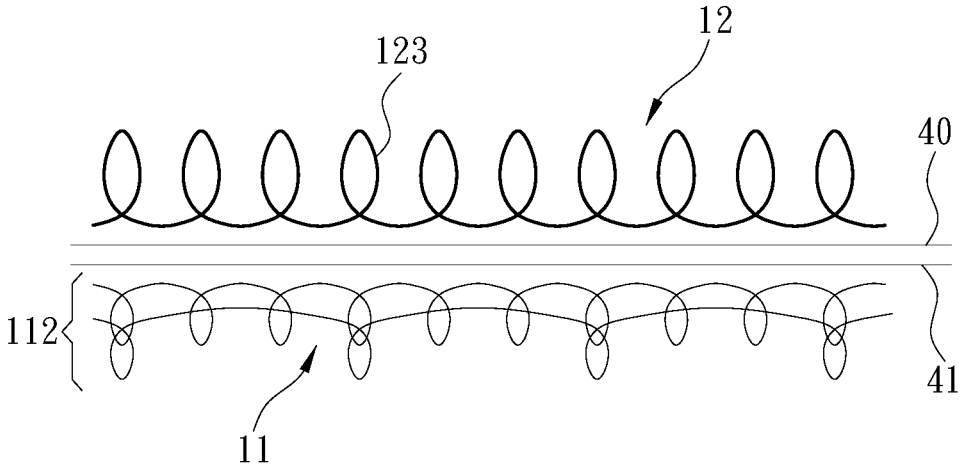
FIG. 6 is a simplified knitting diagram of the knitted fabric of the invention with a course ratio of 1:1.33.

FIG. 6 is a schematic diagram of one embodiment that a course ratio of the face yarn layer 12 to the ground yarn layer 11 is 1:1.33, which is an approximate value. Precisely, the course ratio is written as 1:1+(⅓). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle of every three knitting needles thereof further stitches the ground yarn 112 again. Here, in practical knitting and feeding of the embodiment of FIG. 6, a yarn tension of the face yarn 123 is preferably set as approximately 1/1.33 times a yarn tension of the ground yarn 112.

Figure 7:
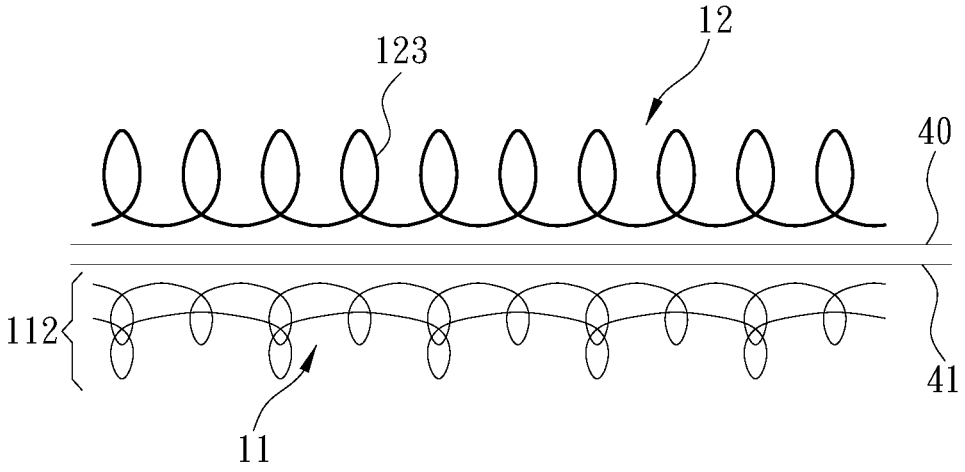
FIG. 7 is a first simplified knitting diagram of the knitted fabric of the invention with a course ratio of 1:1.5.

FIG. 7 is a schematic diagram of one embodiment that a course ratio of the face yarn layer 12 to the ground yarn layer 11 is 1:1.5. Precisely, the course ratio is written as 1:1+(½). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle of every two knitting needles thereof further stitches the ground yarn 112 again. Here, in practical knitting and feeding of the embodiment of FIG. 7, a yarn tension of the face yarn 123 is preferably set as approximately 1/1.5 times a yarn tension of the ground yarn 112.

Figure 8:
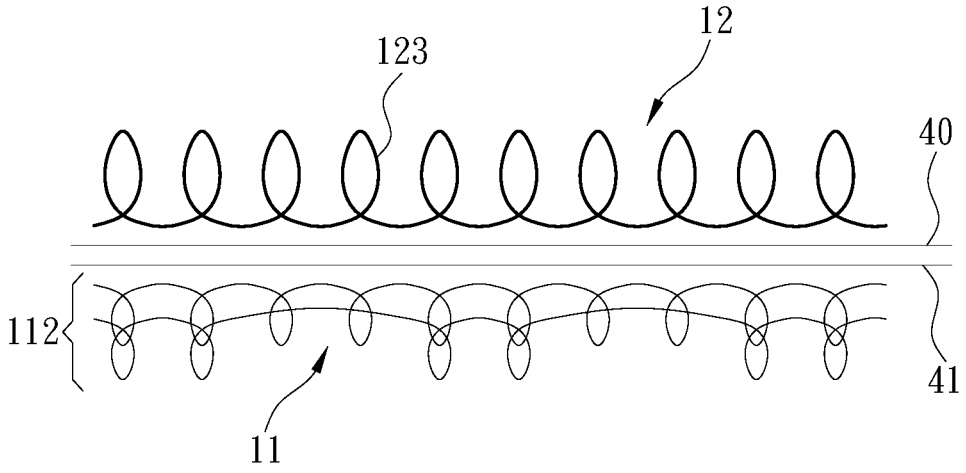
FIG. 8 is a second simplified knitting diagram of the knitted fabric of the invention with a course ratio of 1:1.5.

FIG. 8 is a schematic diagram of one embodiment that a course ratio of the face yarn layer 12 to the ground yarn layer 11 is 1:1.5. Precisely, the course ratio is written as 1:1+(¾). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle and a second knitting needle of every four knitting needles thereof further stitch the ground yarn 112 again. Here, in practical knitting and feeding of the embodiment of FIG. 8, a yarn tension of the face yarn 123 is preferably set as approximately 1/1.5 times a yarn tension of the ground yarn 112.

Figure 9:
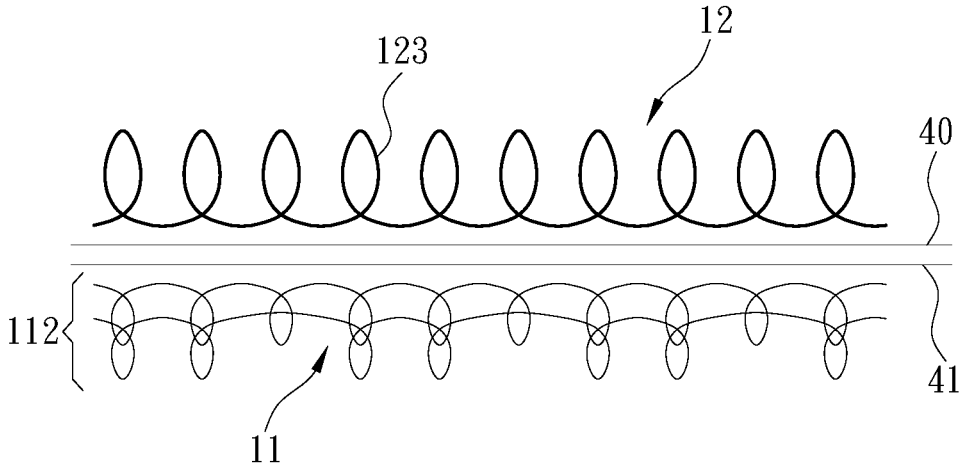
FIG. 9 is a simplified knitting diagram of the knitted fabric of the invention with a course ratio of 1:1.67.

FIG. 9 is a schematic diagram of one embodiment that a course ratio of the face yarn layer 12 to the ground yarn layer 11 is 1:1.67, which an approximate value. Precisely, the course ratio is written as 1:1+(⅔). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle and a second knitting needle of every three knitting needles thereof further stitch the ground yarn 112 again. Here, in practical knitting and feeding of the embodiment of FIG. 9, a yarn tension of the face yarn 123 is preferably set as approximately 1/1.67 times a yarn tension of the ground yarn 112.

Figure 10:
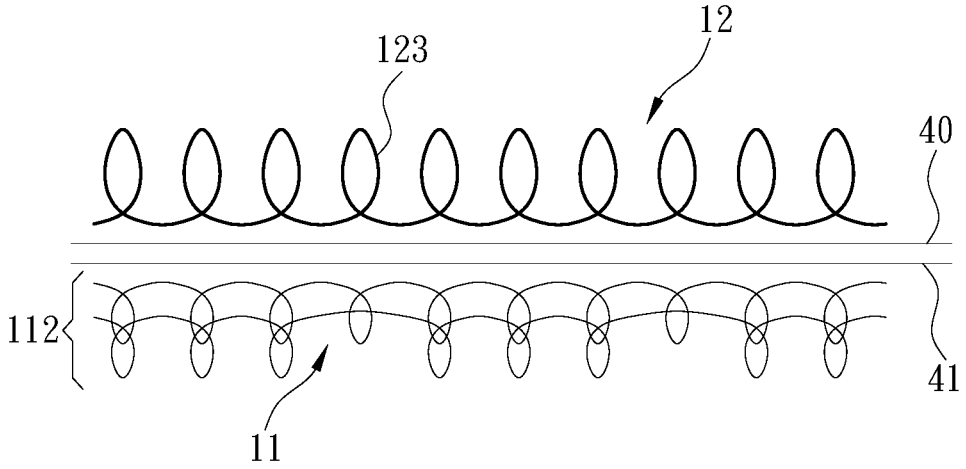
FIG. 10 is a simplified knitting diagram of the knitted fabric of the invention with a course ratio of 1:1.75.

FIG. 10 is a schematic diagram of one embodiment that a course ratio of the face yarn layer 12 to the ground yarn layer 11 is 1:1.75. Precisely, the course ratio is written as 1:1+(¾). In one stroke, each knitting needle of the needle bed 40 for knitting the face yarn layer 12 stitches the face yarn 123 once; and in the same stroke, each knitting needle of the needle bed 41 for knitting the ground yarn layer 11 stitches one ground yarn 112 once, and a first knitting needle, a second knitting needle, and a third knitting needle of every four knitting needles thereof further stitch the ground yarn 112 again. Here, in practical knitting and feeding of the embodiment of FIG. 10, a yarn tension of the face yarn 123 is preferably set as approximately 1/1.75 times a yarn tension of the ground yarn 112.

Figure 11:
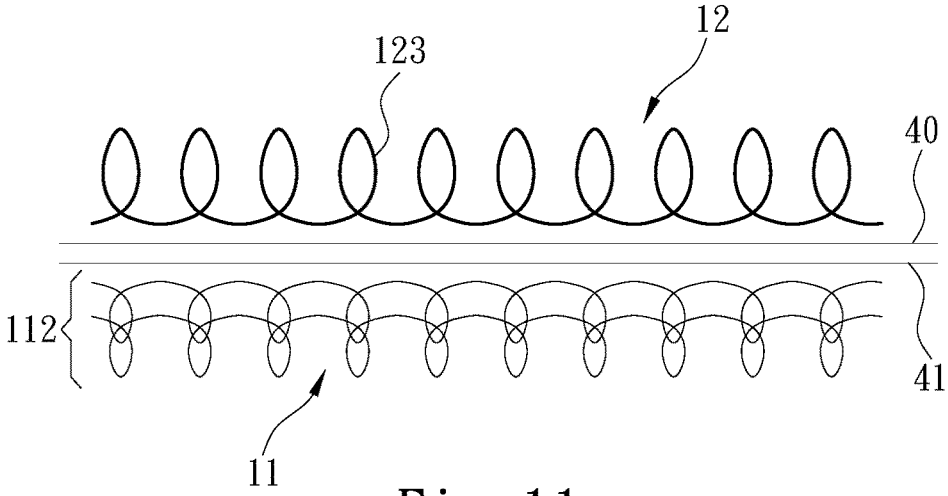
FIG. 11 is a simplified knitting diagram of the knitted fabric of the invention with a course ratio of 1:2.

FIG. 11 is a schematic diagram of one embodiment that a course ratio of the face yarn layer 12 to the ground yarn layer 11 is 1:2. In one stroke, each knitting needle of the needle bed 40 for knitting the face yarn layer 12 stitches the face yarn 123 once; and in the same stroke, two ground yarns 112 are separately stitched once by each knitting needle of the needle bed 41 for knitting the ground yarn layer 11. Here, in practical knitting and feeding of the embodiment of FIG. 11, a yarn tension of the face yarn 123 is preferably set as approximately ½ times a yarn tension of the ground yarn 112.

Figure 12:
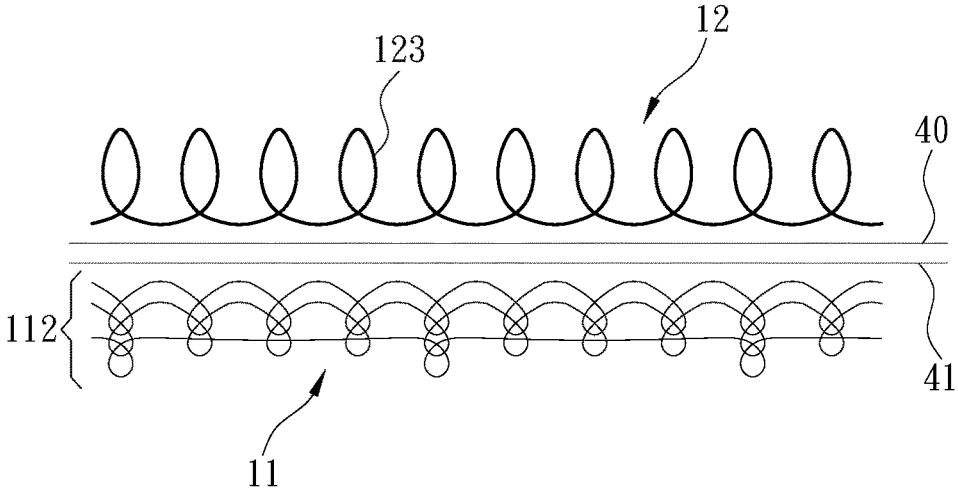
FIG. 12 is a simplified knitting diagram of the knitted fabric of the invention with a course ratio of 1:2.25.

FIG. 12 is a schematic diagram of one embodiment that a course ratio of the face yarn layer 12 to the ground yarn layer 11 is 1:2.25. Precisely, the course ratio is written as 1:2+(¼). In one stroke, each knitting needle of the needle bed 40 for knitting the face yarn layer 12 stitches the face yarn 123 once; and in the same stroke, two ground yarns 112 are separately stitched once by each knitting needle of the needle bed 41 for knitting the ground yarn layer 11, and a first knitting needle of every four knitting needles thereof further stitches one ground yarn 112 again. Here, in practical knitting and feeding of the embodiment of FIG. 12, a yarn tension of the face yarn 123 is preferably set as approximately 1/2.25 times a yarn tension of the ground yarn 112.

Figure 13:
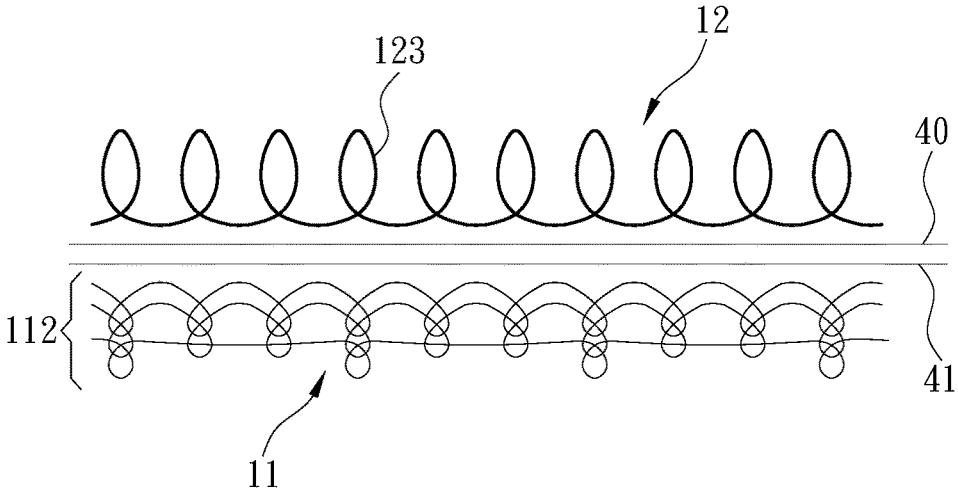
FIG. 13 is a simplified knitting diagram of the knitted fabric of the invention with a course ratio of 1:2.33.

FIG. 13 is a schematic diagram of one embodiment that a course ratio of the face yarn layer 12 to the ground yarn layer 11 is 1:2.33, which is an approximate value. Precisely, the course ratio is written as 1:2+(⅓). In one stroke, each knitting needle of the needle bed 40 for knit the face yarn layer 12 stitches the face yarn 123 once; and in the same stroke, two ground yarns 112 are separately stitched once by each knitting needle of the needle bed 41 for knitting the ground yarn layer 11, and a first knitting needle of every three knitting needles thereof further stitches one ground yarn 112 again. Here, in practical knitting and feeding of the embodiment of FIG. 13, a yarn tension of the face yarn 123 is preferably set as approximately 1/2.33 times a yarn tension of the ground yarn 112.

Figure 14:
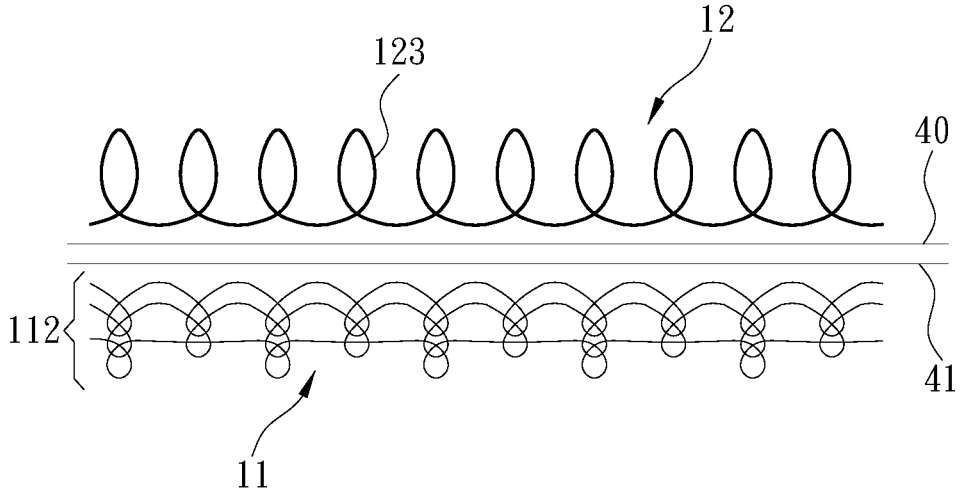
FIG. 14 is a first simplified knitting diagram of the knitted fabric of the invention with a course ratio of 1:2.5.

FIG. 14 is a schematic diagram of one embodiment that a course ratio of the face yarn layer 12 to the ground yarn layer 11 is 1:2.5. Precisely, the course ratio is written as 1:2+(½). In one stroke, each knitting needle of the needle bed 40 for knitting the face yarn layer 12 stitches the face yarn 123 once; and in the same stroke, two ground yarns 112 are separately stitched once by each knitting needle of the needle bed 41 for knitting the ground yarn layer 11, and a first knitting needle of every two knitting needles thereof further stitches one ground yarn 112 again. Here, in practical knitting and feeding of the embodiment of FIG. 14, a yarn tension of the face yarn 123 is preferably set as approximately 1/2.5 times a yarn tension of the ground yarn 112.

Figure 15:
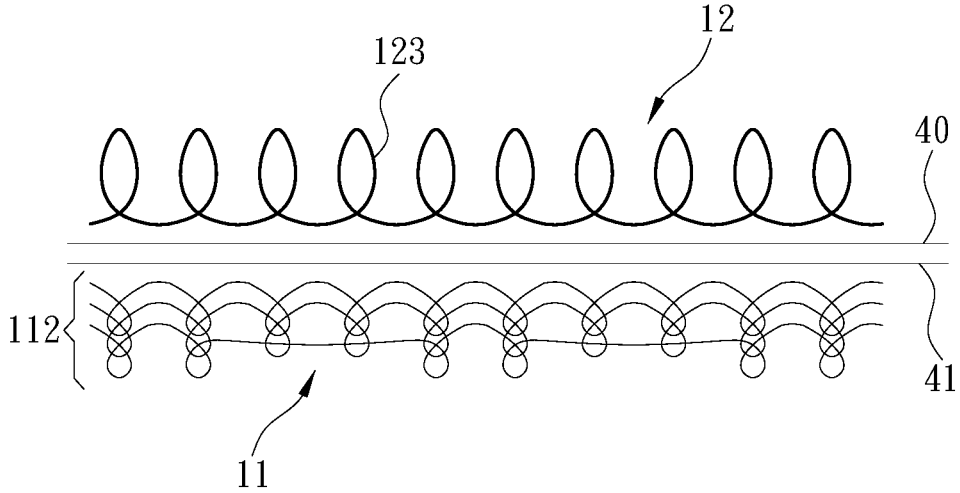
FIG. 15 is a second simplified knitting diagram of the knitted fabric of the invention with a course ratio of 1:2.5.

FIG. 15 is a schematic diagram of one embodiment that a course ratio of the face yarn layer 12 to the ground yarn layer 11 is 1:2.5. Precisely, the course ratio is written as 1:2+(2/4). In one stroke, each knitting needle for the needle bed 40 for knitting the face yarn layer 12 stitches the face yarn 123 once; and in the same stroke, two ground yarns 112 are separately stitched once by each knitting needle of the needle bed 41 for knitting the ground yarn layer 11, and a first knitting needle and a second knitting needle of every four knitting needles thereof further stitch one ground yarn 112 again. Here, in practical knitting and feeding of the embodiment of FIG. 15, a yarn tension of the face yarn 123 is preferably set as approximately 1/2.5 times a yarn tension of the ground yarn 112.

Figure 16:
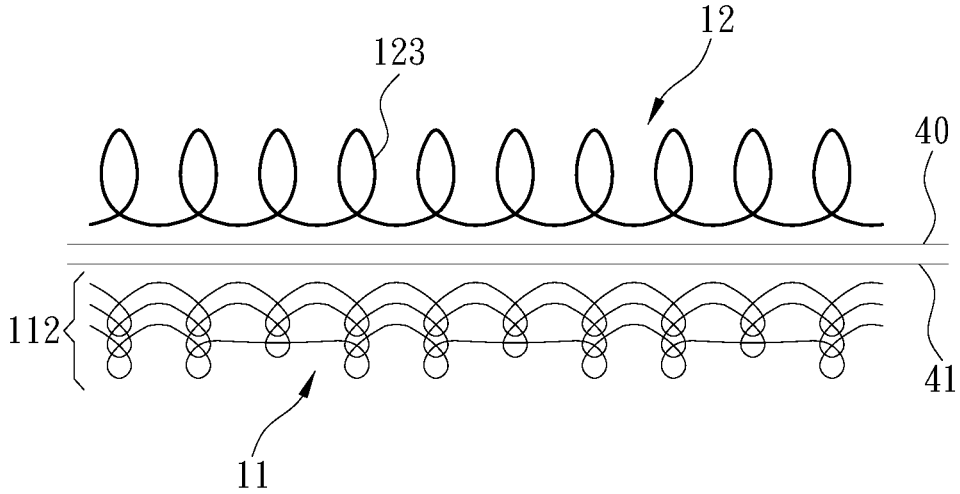
FIG. 16 is a simplified knitting diagram of the knitted fabric of the invention with a course ratio of 1:2.67.

FIG. 16 is a schematic diagram of one embodiment that a course ratio of the face yarn layer 12 to the ground yarn layer 11 is 1:2.67, which is an approximate value. Precisely, the course ratio is written as 1:2+(2/3). In one stroke, each knitting needle of the needle bed 40 for knitting the face yarn layer 12 stitches the face yarns 123 once; and in the same stroke, two ground yarns 112 are separately stitched once by each knitting needle of the needle bed 41 for knitting the ground yarn layer 11, and a first knitting needle and a second knitting needle of every three knitting needles thereof further stitch one ground yarn 112 again. Here, in practical knitting and feeding of the embodiment of FIG. 16, a yarn tension of the face yarn 123 is preferably set as approximately 1/2.67 times a yarn tension of the ground yarn 112.

Figure 17:
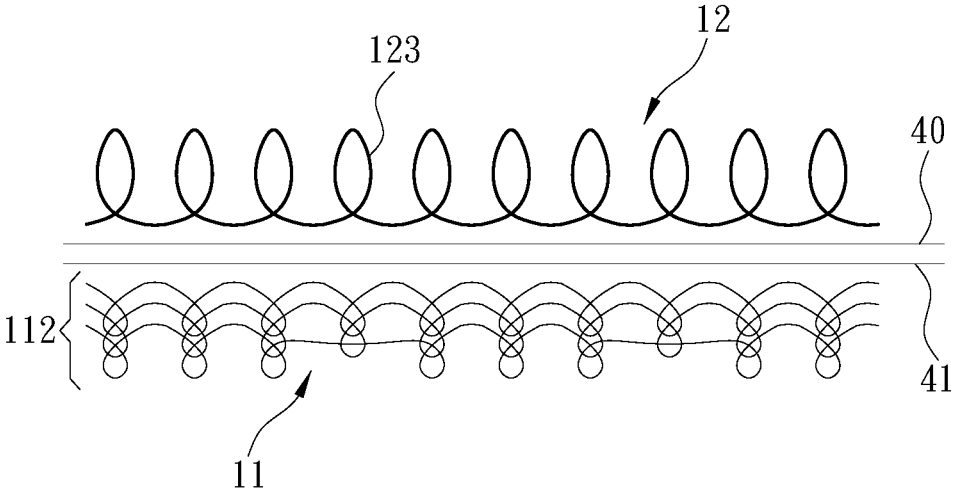
FIG. 17 is a simplified knitting diagram of the knitted fabric of the invention with a course ratio of 1:2.75.

FIG. 17 is a schematic diagram of one embodiment that a course ratio of the face yarn layer 12 to the ground yarn layer 11 is 1:2.75. Precisely, the course ratio is written as 1:2+(3/4). In one stroke, each knitting needle of the needle bed 40 for knitting the face yarn layer 12 stitches the face yarn 123 once; and in the same stroke, two ground yarns 112 are separately stitched once by each knitting needle of the needle bed 41 for knitting the ground yarn layer 11, and a first knitting needle, a second knitting needle, and a third knitting needle of every four knitting needles thereof further stitch one ground yarn 112 again. Here, in practical knitting and feeding of the embodiment of FIG. 17, a yarn tension of the face yarn 123 is preferably set as approximately 1/2.75 times a yarn tension of the ground yarn 112.

Figure 18:
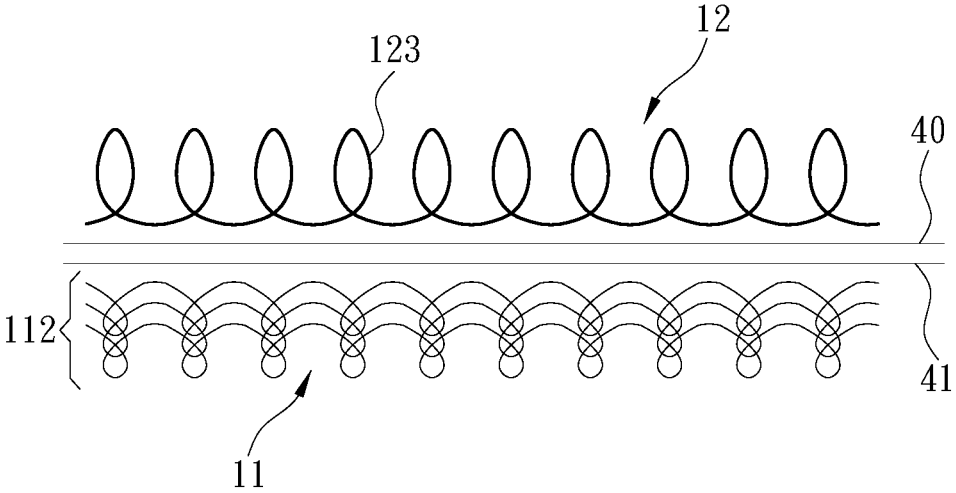
FIG. 18 is a simplified knitting diagram of the knitted fabric of the invention with a course ratio of 1:3.

FIG. 18 is a schematic diagram of one embodiment that a course ratio of the face yarn layer 12 to the ground yarn layer 11 is 1:3. In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11. Here, in practical knitting and feeding of the embodiment of FIG. 18, a yarn tension of the face yarn 123 is preferably set as approximately 1/3 times a yarn tension of the ground yarn 112.

Figure 19:
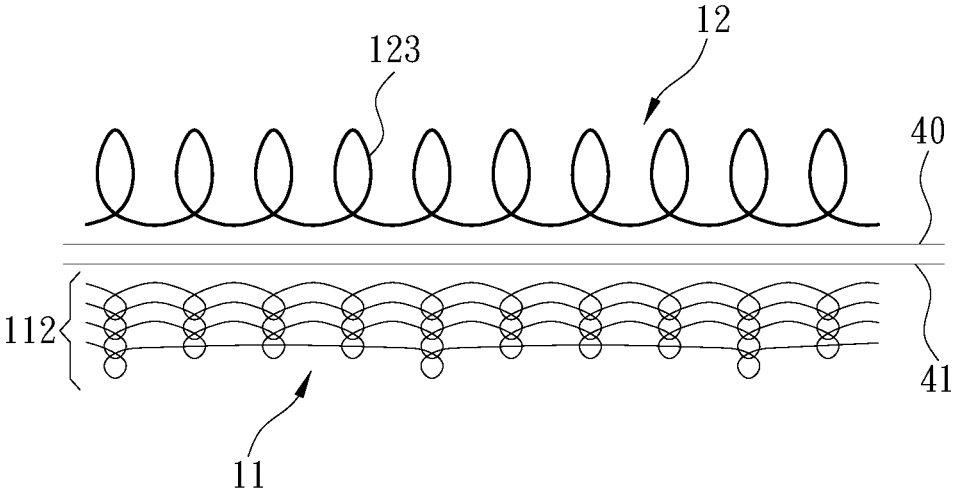
FIG. 19 is a simplified knitting diagram of the knitted fabric of the invention with a course ratio of 1:3.25.

FIG. 19 is a schematic diagram of one embodiment that a course ratio of the face yarn layer 12 to the ground yarn layer 11 is 1:3.25. Precisely, the course ratio is written as 1:3+(1/4). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle of every four knitting needles thereof further stitches one ground yarn 112 again. Here, in practical knitting and feeding of the embodiment of FIG. 19, a yarn tension of the face yarn 123 is preferably set as approximately 1/3.25 times a yarn tension of the ground yarn 112.

Figure 20:
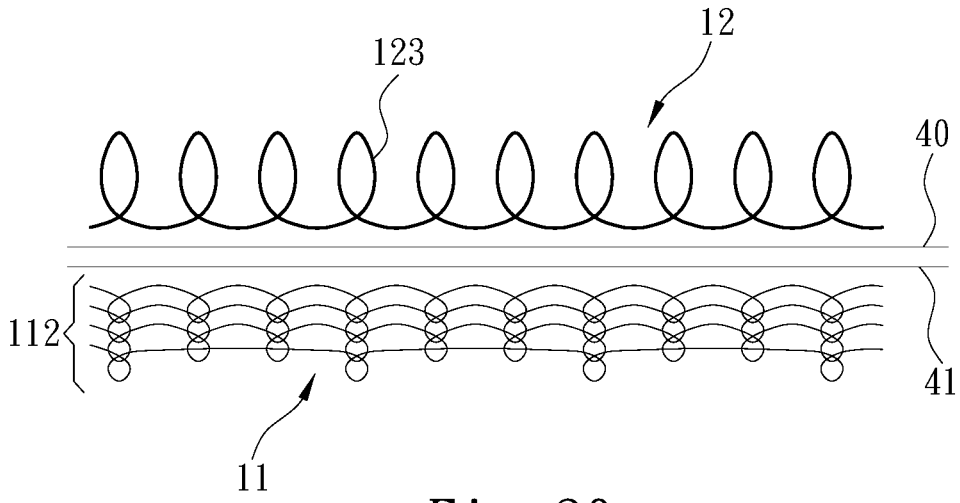
FIG. 20 is a simplified knitting diagram of the knitted fabric of the invention with a course ratio of 1:3.33.

FIG. 20 is a schematic diagram of one embodiment that a course ratio of the face yarn layer 12 to the ground yarn layer 11 is 1:3.33, which is an approximate value. Precisely, the course ratio is written as 1:3+(1/3). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle of every three knitting needles thereof further stitches one ground yarn 112 again. Here, in practical knitting and feeding of the embodiment of FIG. 20, a yarn tension of the face yarn 123 is preferably set as approximately 1/3.33 times a yarn tension of the ground yarn 112.

Figure 21:
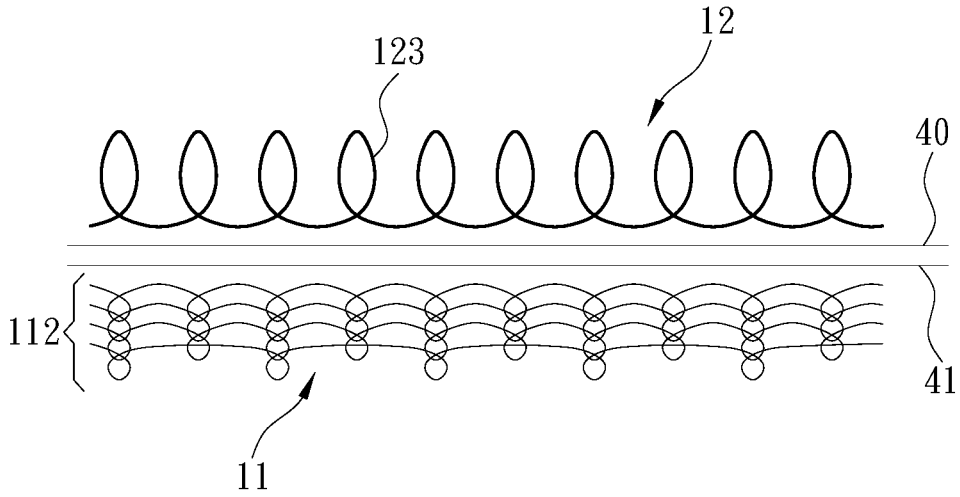
FIG. 21 is a first simplified knitting diagram of the knitted fabric of the invention with a course ratio of 1:3.5.

FIG. 21 is a schematic diagram of one embodiment that a course ratio of the face yarn layer 12 to the ground yarn layer 11 is 1:3.5. Precisely, the course ratio is written as 1:3+(1/2). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle of every two knitting needles thereof further stitches one ground yarn 112 again. Here, in practical knitting and feeding of the embodiment of FIG. 21, a yarn tension of the face yarn 123 is preferably set as approximately 1/3.5 times a yarn tension of the ground yarn 112.

Figure 22:
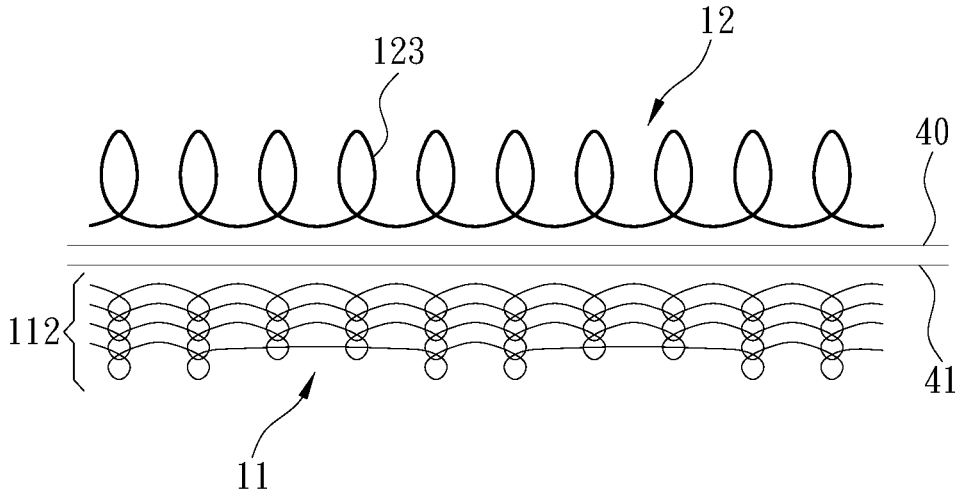
FIG. 22 is a second simplified knitting diagram of the knitted fabric of the invention with a course ratio of 1:3.5.

FIG. 22 is a schematic diagram of one embodiment that a course ratio of the face yarn layer 12 to the ground yarn layer 11 is 1:3.5. Precisely, the course ratio is written as 1:3+(2/4). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle and a second knitting needle of every four knitting needles thereof further stitch one ground yarn 112 again. Here, in practical knitting and feeding of the embodiment of FIG. 22, a yarn tension of the face yarn 123 is preferably set as approximately 1/3.5 times a yarn tension of the ground yarn 112.

Figure 23:
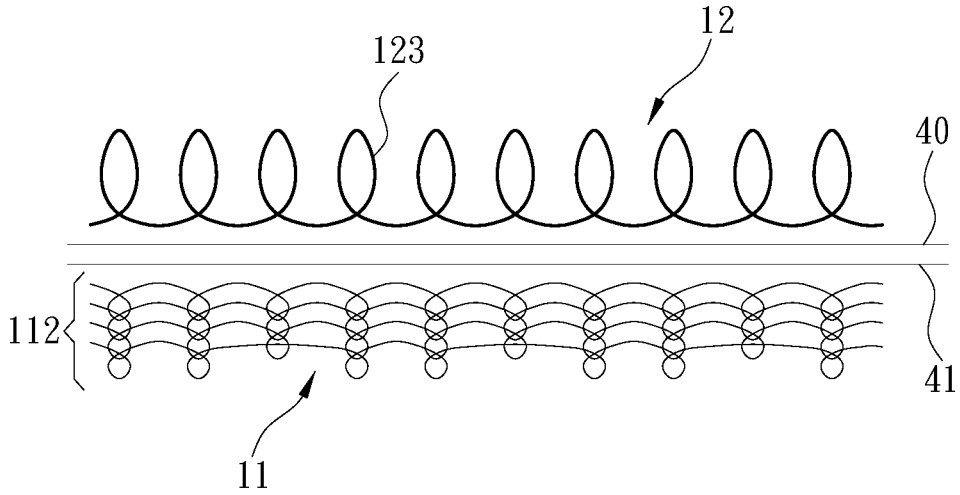
FIG. 23 is a simplified knitting diagram of the knitted fabric of the invention with a course ratio of 1:3.67.

FIG. 23 is a schematic diagram of one embodiment that a course ratio of the face yarn layer 12 to the ground yarn layer 11 is 1:3.67, which is an approximate value. Precisely, the course ratio is written as 1:3+(2/3). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle and a second knitting needle of every three knitting needles thereof further stitch one ground yarn 112 again. Here, in practical knitting and feeding of the embodiment of FIG. 23, a yarn tension of the face yarn 123 is preferably set as approximately 1/3.67 times a yarn tension of the ground yarn 112.

Figure 24:
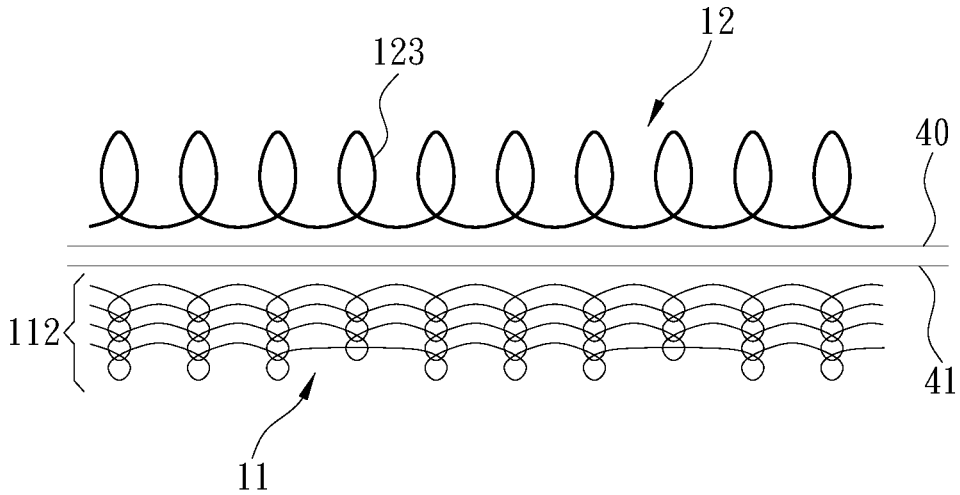
FIG. 24 is a simplified knitting diagram of the knitted fabric of the invention with a course ratio of 1:3.75.

FIG. 24 is a schematic diagram of one embodiment that a course ratio of the face yarn layer 12 to the ground yarn layer 11 is 1:3.75. Precisely, the course ratio is written as 1:3+(3/4). In one stroke, each knitting needle of the needle bed 40 for knitting the face yarn layer 12 stitches the face yarns 123 once; and in the same stroke, three ground yarns 112 are separately stitched once by each knitting needle of the needle bed 41 for knitting the ground yarn layer 11, and a first knitting needle, a second knitting needle, and a third knitting needle of every four knitting needles thereof further stitch one ground yarn 112 again. Here, in practical knitting and feeding of the embodiment of FIG. 24, a yarn tension of the face yarn 123 is preferably set as approximately 1/3.75 times a yarn tension of the ground yarn 112.

Figure 25:
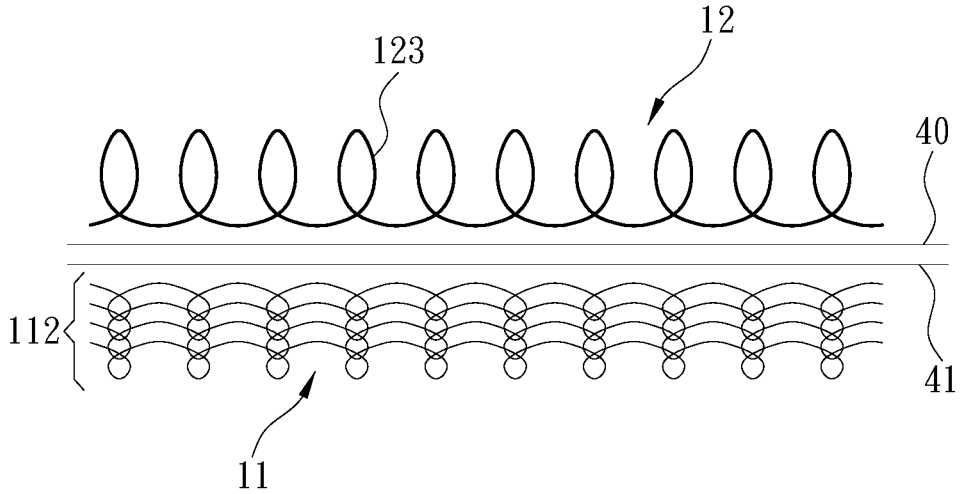
FIG. 25 is a simplified knitting diagram of the knitted fabric of the invention with a course ratio of 1:4.

FIG. 25 is a schematic diagram of one embodiment that a course ratio of the face yarn layer 12 to the ground yarn layer 11 is 1:4. In one stroke, each knitting needle of the needle bed 40 for knitting the face yarn layer 12 stitches the face yarns 123 once; and in the same stroke, four ground yarns 112 are separately stitched once by each knitting needle of the needle bed 41 for knitting the ground yarn layer 11. Here, in practical knitting and feeding of the embodiment of FIG. 25, a yarn tension of the face yarn 123 is preferably set as approximately ¼ times a yarn tension of the ground yarn 112.

Figure 26:
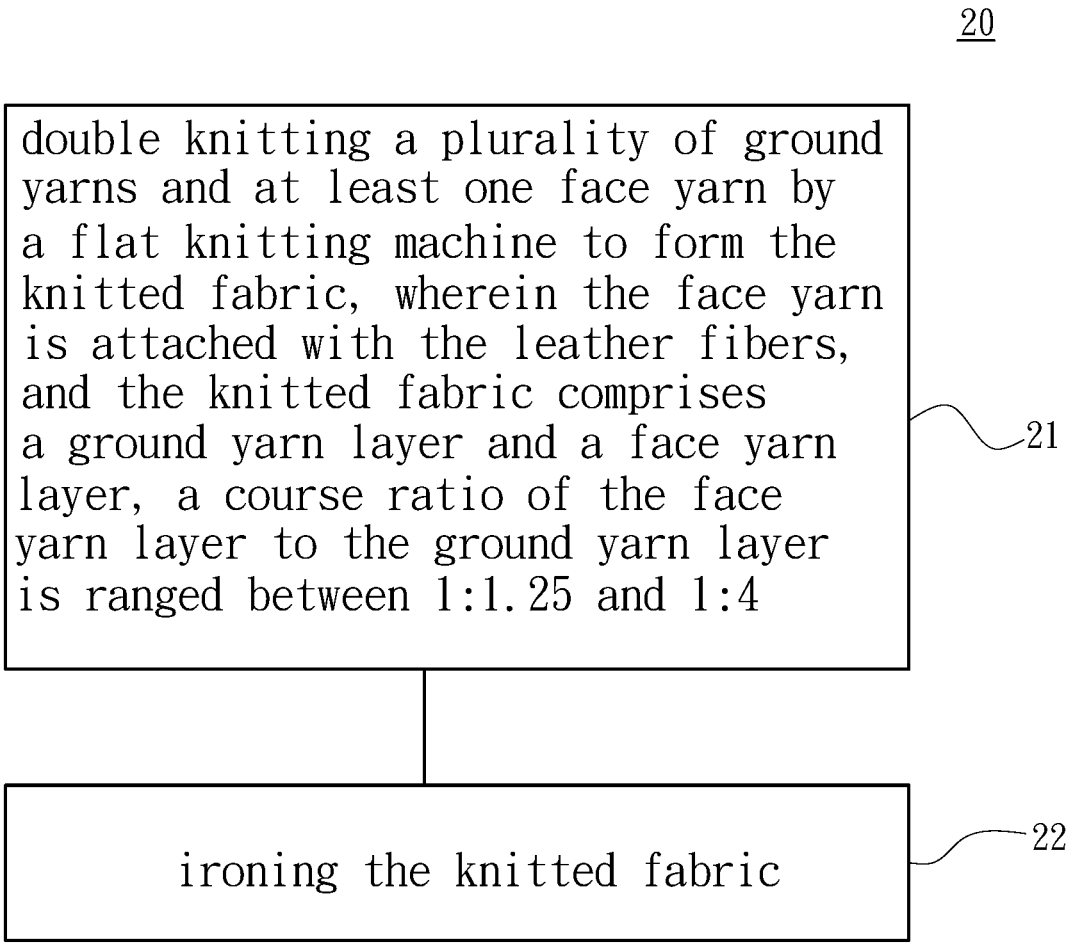
FIG. 26 is an implementation flow chart of a first embodiment of a manufacturing method of the invention.

Please refer to FIG. 1 and FIG. 26, a manufacturing method 20 for the knitted fabric 10 of the invention comprises following steps of:

step A 21: double knitting the plurality of ground yarns 112 and the at least one face yarn 123 by the flat knitting machine to form the knitted fabric 10; and step B 22: ironing the knitted fabric 10.

The invention avoids fabric curling caused by differences in numbers of yarn loops between the face yarn layer 12 and the ground yarn layer 11, since provides step B 22 that further irons the knitted fabric 10 after the knitted fabric 10 is formed to increase flatness of the knitted fabric 10.

Figure 27:
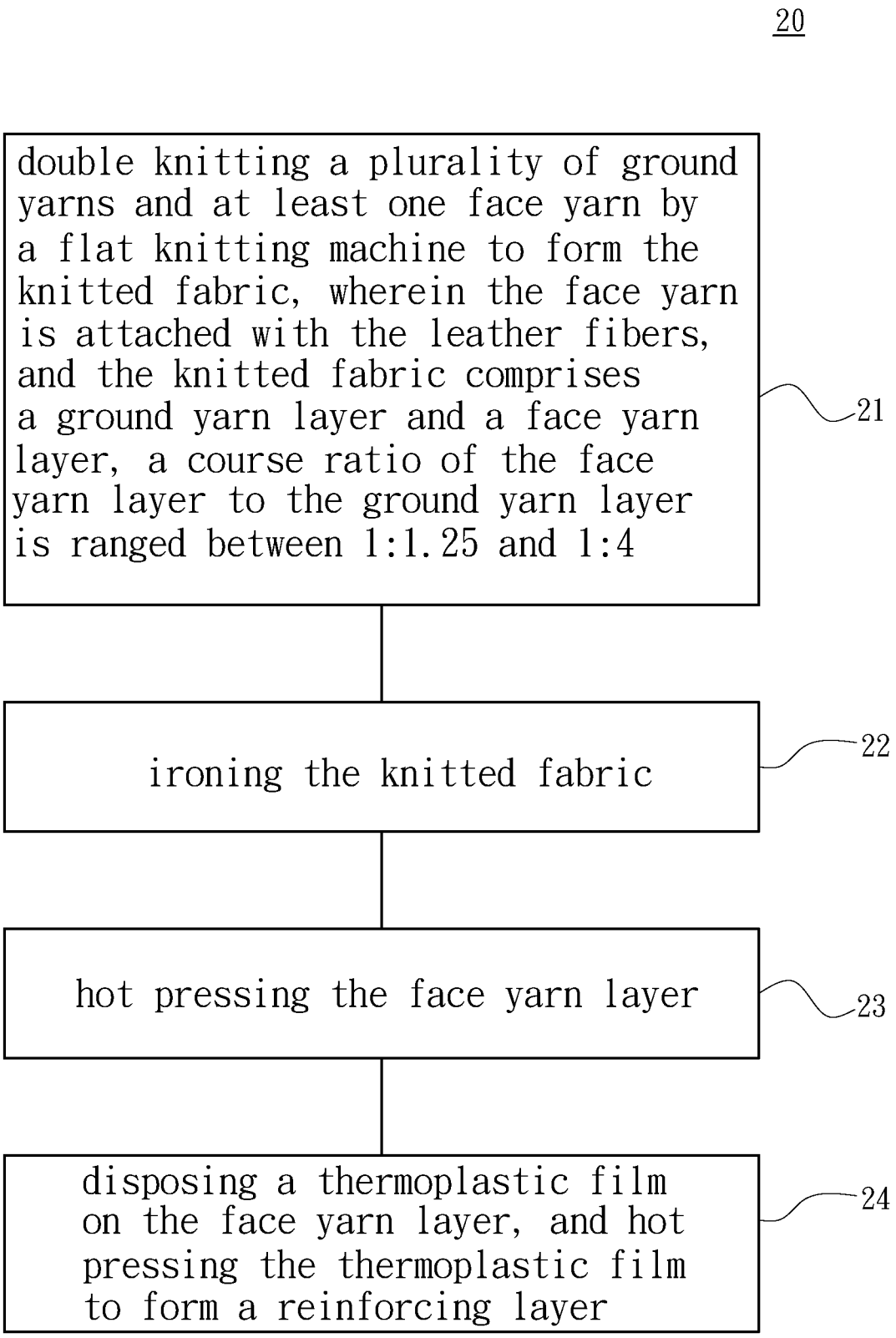
FIG. 27 is an implementation flow chart of a second embodiment of the manufacturing method of the invention.

Please refer to FIG. 2 and FIG. 27. Based on the foregoing description, in one embodiment, the face yarn 123 is composed of the base yarn 124 and the polyurethane (PU) layer 125 which is wrapped around the outer surface of the base yarn 124 and comprises the leather fibers 122. Since the face yarn 123 may shrink after being manufactured, the manufacturing method 20 further includes step C 23: hot pressing the face yarn layer 12 after ironing the knitted fabric 10. A heating copper piece or other objects with same functions can be implemented in step C 23 to perform hot pressing. Furthermore, step C 23 practically performs hot pressing on one single side of the face yarn layer 12 to prevent the face yarn 123 from shrinking to causes the knitted fabric 10 curling.

Figure 28:
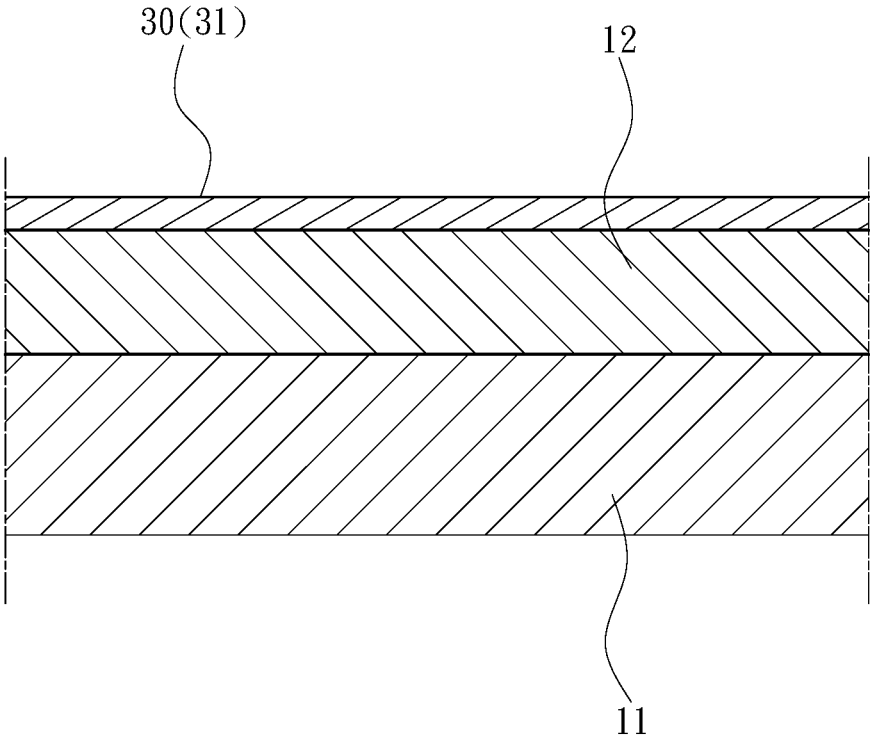
FIG. 28 is a schematic diagram of structure of a fourth embodiment of the knitted fabric of the invention.

Please refer to FIG. 27 and FIG. 28. In one embodiment, the manufacturing method 20 includes step D 24: disposing a thermoplastic film 30 on the face yarn layer 12, and hot pressing the thermoplastic film 30 to form a reinforcing layer 31. In this embodiment, the knitted fabric 10 is hot pressed twice, wherein first is performed in step C 23, and second is performed in step D 24. However, there are two different subjects be hot pressed, one is that the face yarn layer 12 is hot pressed in the first hot pressing, and the other is that the thermoplastic film 30 is hot pressed in the second hot pressing. The thermoplastic film 30 after being hot pressed not only improves a strength of the face yarn layer 12, but also improves a gloss of the face yarn layer 12, so that the tactile feeling of the face yarn layer 12 is to be smoother, and the knitted fabric 10 is more aesthetic visually. In another embodiment, a mold (not shown in the figures) is applied to hot press on the thermoplastic film 30 in step D 24 to form a plurality of leather textures on the reinforcing layer 31. Thus, not only the visual aesthetics of the knitted fabric 10 can be enhanced through the foregoing embodiment, but also the strength of the knitted fabric 10 can be enhanced.

What is claimed is:

1. A knitted fabric with leather fibers, comprising:

a ground yarn layer, including a plurality of first yarn loops, each of the plurality of first yarn loops formed with at least one ground yarn; and a face yarn layer, directly connected to the ground yarn layer through double knitting, and the face yarn layer including a plurality of second yarn loops, each of the plurality of second yarn loops formed with at least one face yarn, the at least one face yarn attached with the leather fibers, wherein the leather fibers are obtained from a piece of leather by a pulverization operation, and a course ratio of the face yarn layer to the ground yarn layer is ranged between 1:1.25 and 1:4.

2. The knitted fabric with leather fibers as claimed in claim 1, wherein the at least one face yarn includes a base yarn and a polyurethane (PU) layer which is wrapped around a surface of the base yarn, and the polyurethane layer comprises the leather fibers.

3. The knitted fabric with leather fibers as claimed in claim 2, wherein the base yarn is made of thermoplastic polyurethane (TPU).

4. The knitted fabric with leather fibers as claimed in claim 3, wherein the knitted fabric includes a reinforcing layer provided on a side of the face yarn layer that is opposite to the ground yarn layer.

5. The knitted fabric with leather fibers as claimed in claim 1, wherein the knitted fabric includes a reinforcing layer provided on a side of the face yarn layer that is opposite to the ground yarn layer.

6. The knitted fabric with leather fibers as claimed in claim 4, wherein a plurality of leather textures are formed on the reinforcing layer.

* * * * *